US009169096B2

(12) United States Patent
Scamara

(10) Patent No.: US 9,169,096 B2
(45) **Date of Patent: *Oct. 27, 2015**

(54) ROLLER SYSTEM

(71) Applicant: Clifford Scamara, Brea, CA (US)

(72) Inventor: Clifford Scamara, Brea, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/454,707

(22) Filed: Aug. 7, 2014

(65) Prior Publication Data

US 2015/0158689 A1 Jun. 11, 2015

Related U.S. Application Data

(63) Continuation of application No. 14/097,249, filed on Dec. 5, 2013, now Pat. No. 8,840,055.

(51) Int. Cl.

| | |
|---|---|
| ***B65H 75/40*** | (2006.01) |
| ***B65H 18/16*** | (2006.01) |
| ***A63G 31/12*** | (2006.01) |

(52) U.S. Cl.

CPC ..... *B65H 18/16* (2013.01); *A63G 31/12* (2013.01)

(58) Field of Classification Search

USPC ..... 242/533.8, 403, 403.1, 557; 156/714, 156/763

See application file for complete search history.

(56) References Cited

U.S. PATENT DOCUMENTS

| | | | | |
|---|---|---|---|---|
| 2,655,976 | A * | 10/1953 | Lovin | 156/714 |
| 4,948,451 | A * | 8/1990 | Foltz | 156/763 |
| 6,113,075 | A * | 9/2000 | McMichael et al. | 254/203 |
| 6,595,261 | B2 * | 7/2003 | Fitterer | 156/763 |
| 7,850,249 | B2 * | 12/2010 | Manners | 299/36.1 |
| 8,251,117 | B2 * | 8/2012 | Kron et al. | 156/762 |

* cited by examiner

*Primary Examiner* — Sang Kim

(74) *Attorney, Agent, or Firm* — John D. Tran; Rhema Law Group

(57) ABSTRACT

A roller system can include: a rear rolling member configured for rolling contact with a surface; a front rolling member rotating in an opposite direction to the rear rolling member and the front rolling member configured to be elevated above the surface during use; and a chassis coupling the rear rolling member to the front rolling member.

17 Claims, 4 Drawing Sheets

ROLLER SYSTEM

CROSS-REFERENCE TO RELATED APPLICATION(S)

This is a continuation of U.S. patent application Ser. No. 14/097,249 entitled "Motorized Roller Apparatus for Rolled Objects and Methods of Use" filed Dec. 5, 2013 and claims priority benefit to all common subject matter. The entire content of this application is incorporated herein by reference.

TECHNICAL FIELD

This disclosure relates to rolling devices, more particularly to a motorized roller apparatus configured for assisting in the selective rolling and unrolling of rolled objects.

BACKGROUND

By way of background, inflatable structures—such as bounce houses, slides and the like—have become increasingly popular over the years for recreational purposes; particularly for children. This growth in popularity has led to an inflatable rental industry through which companies deliver and set up these structures for special events, then subsequently return to deflate and haul them away. This is primarily because inflatable structures are relatively durable and easy to transport and store. However, because these structures are typically composed of thick, strong PVC, vinyl or nylon, and because their relative sizes and dimensions can be fairly large, they have the potential to be very heavy—oftentimes weighing hundreds, sometimes thousands, of pounds.

Each inflatable structure is typically stored and transported as a deflated, substantially cylindrical-shaped roll so as to be as compact and portable as possible. Traditionally, upon the delivery of an inflatable structure to an event site, the rolled inflatable must be laid on the ground, then manually unrolled by hand or using some other manual rolling device. Given the weight of the rolled inflatable, this unrolling process often requires multiple people and can be fairly time consuming. Additionally, upon deflating the structure after an event, the flattened inflatable must be subsequently rolled back up before hauling it away. Thus, as one can appreciate, this process can be very strenuous. In fact, many people in this industry find themselves having back-related medical issues within just a few years of routinely rolling and unrolling these inflatable structures manually.

Similar problems are present in other industries that involve the manual rolling and/or unrolling of large and/or heavy rolled objects—such as carpeting, for example.

Solutions have been long sought but prior developments have not taught or suggested complete solutions, and solutions to these problems have long eluded those skilled in the art. Thus there remains a considerable need for devices and methods for cost-effective means of reducing the amount of manual labor required to roll or unroll large or heavy rolled objects.

SUMMARY

Contemplated embodiments of the roller system can include systems and methods having a rear rolling member configured for rolling contact with a surface; a front rolling member rotating in an opposite direction to the rear rolling member and the front rolling member configured to be elevated above the surface during use; and a chassis coupling the rear rolling member to the front rolling member.

Accordingly it has been discovered that one or more embodiments described herein set forth an apparatus that is capable of providing a cost-effective means for reducing the amount of manual labor required to roll and/or unroll large and/or heavy rolled objects, in at least one embodiment. One or more embodiments described herein further set forth an apparatus that is capable of significantly reducing the amount of time required to roll and/or unroll such rolled objects, in at least one embodiment.

Furthermore, one or more embodiments described herein set forth an apparatus that is capable of selectively rolling and unrolling a wide range of rolled objects, in at least one embodiment. Yet further, one or more embodiments described herein set forth an apparatus that is capable of being transported with relative ease, in at least one embodiment.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The roller system is illustrated in the figures of the accompanying drawings which are meant to be exemplary and not limiting, in which like reference numerals are intended to refer to like components, and in which.

DETAILED DESCRIPTION

Figure 1:
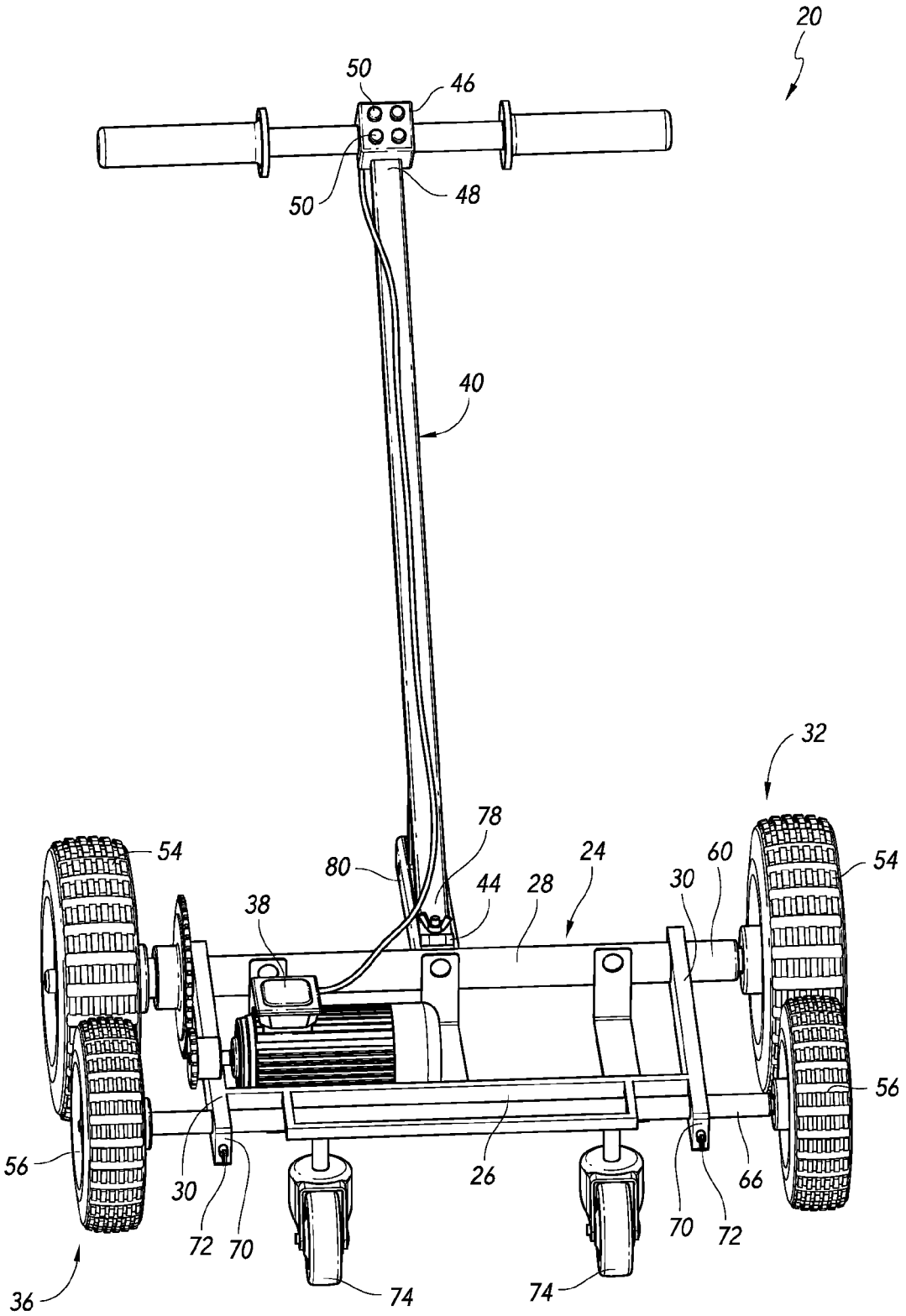
FIG. 1 is an isometric view of the roller system in an embodiment.

In the following description, reference is made to the accompanying drawings that form a part hereof, and in which are shown by way of illustration, embodiments in which the roller system may be practiced. It is to be understood that other embodiments may be utilized and structural changes may be made without departing from the scope of the roller system.

The roller system is described in sufficient detail to enable those skilled in the art to make and use the roller system and provide numerous specific details to give a thorough understanding of the roller system; however, it will be apparent that the roller system may be practiced without these specific details.

In order to avoid obscuring the roller system, some well-known system configurations are not disclosed in detail Likewise, the drawings showing embodiments of the system are semi-diagrammatic and not to scale and, particularly, some of the dimensions are for the clarity of presentation and are shown greatly exaggerated in the drawing FIGS. Generally, the roller system can be operated in any orientation.

Figure 4:
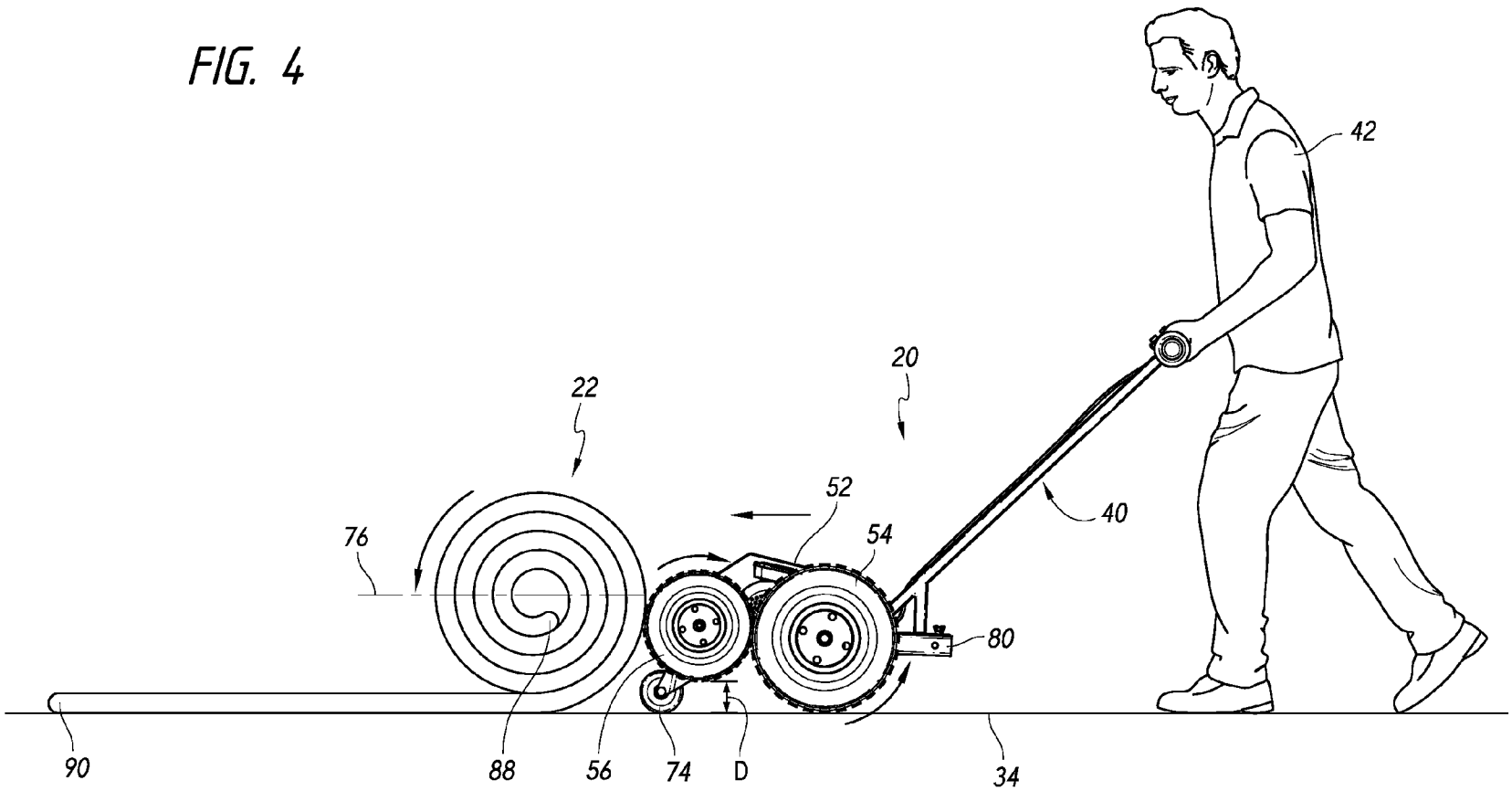
FIG. 4 is a side view of the roller system of FIG. 1 in a forward rolling phase of operation.

Turning now to FIG. 1, therein is shown an isometric view of an embodiment of a motorized roller apparatus 20 configured for assisting in the selective rolling and unrolling of an at least one rolled object 22 of FIG. 4. At the outset, it should be noted that, for purely illustrative purposes, the apparatus 20 is described primarily in the context of rolled inflatable structures; however, use of the apparatus 20 should not be read as being so limited. In fact, in one or more embodiments, the apparatus 20 is able to be used in the rolling or unrolling of any other object, now known or later developed, capable of being selectively rolled into a substantially cylindrical-shaped configuration—such as carpeting, for example.

With continued reference to FIG. 1, the apparatus 20 comprises, in at least one embodiment, a chassis 24 having a front end 26, an opposing spaced apart rear end 28, and two laterally opposed spaced apart sides 30. The chassis 24 provides an at least one rear rolling member 32 rotatably engaged proximal the rear end 28 of the chassis 24 and configured for being in rolling contact with the surface on which the rolled object 22 is positioned (hereinafter referred to generally as the "ground" 34) during use of the apparatus 20 (as shown in FIG. 4). The chassis 24 also provides an at least one front rolling member 36 rotatably engaged proximal the front end 26 of the chassis 24 and configured for being selectively positioned in rolling contact with the rolled object 22 during use of the apparatus 20 (as also shown in FIG. 4). Additionally, in at least one embodiment and as discussed further below, the front and rear rolling members 36 and 32 are in rolling contact with one another.

Given that the rear rolling member 32 is configured for being in rolling contact with the ground 34 during use of the apparatus 20, the rear rolling member 32 enables the apparatus 20 to travel across the ground 34 in a desired direction. To assist in this functionality, the apparatus 20 provides, in at least one embodiment, a motor 38 mounted on the chassis 24 and interconnected with the rear rolling member 32—either directly or indirectly—for driving the selective rotation of the rear rolling member 32.

The size and power of the motor 38 may vary in any given embodiment, depending primarily on the size and type of rolled objects 22 on which the apparatus 20 is to be used—the larger the rolled object 22, the larger and more powerful the motor 38. Thus, the size of the particular motor 38 shown in the drawings is merely exemplary. Similarly, the specific size and dimensions of the chassis 24, along with the front and rear rolling members 36 and 32, may vary in any given embodiment as well—again, depending on the size and type of rolled objects 22 on which the apparatus 20 is to be used.

With continued reference to FIG. 1, in at least one embodiment, the apparatus 20 further provides an elongate handle portion 40 engaged with the rear end 28 of the chassis 24 and configured for allowing a user 42 to operate and steer the apparatus 20 during use (as shown in FIG. 4). In one such embodiment, the handle portion 40 is rigidly engaged with the rear end 28 of the chassis 24.

However, in an alternate embodiment, the handle portion 40 is engaged with the rear end 28 of the chassis 24 via a hinge 44—the purpose for which is discussed further below. In still further embodiments, the handle portion 40 may be engaged anywhere else on the chassis 24, so long as the apparatus 20 is substantially capable of carrying out the functionality herein described. Similarly, the size and dimensions of the handle portion 40 shown in the drawings is merely exemplary and may vary in further embodiments, so long as the apparatus 20 is substantially capable of carrying out the functionality herein described.

In at least one embodiment, a control panel 46 is engaged with the handle portion 40, proximal an upper end 48 of the handle portion 40. The control panel 46 provides an at least one control button 50 (or switch) in communication with, and configured for allowing the user 42 to selectively control, the motor 38. For example, in the exemplary embodiment, the control panel 46 provides control buttons 50 configured for turning the motor 38 on and off, as well as for causing the motor 38 to rotate the rear rolling member 32 in a forward or reverse direction.

Figure 2:
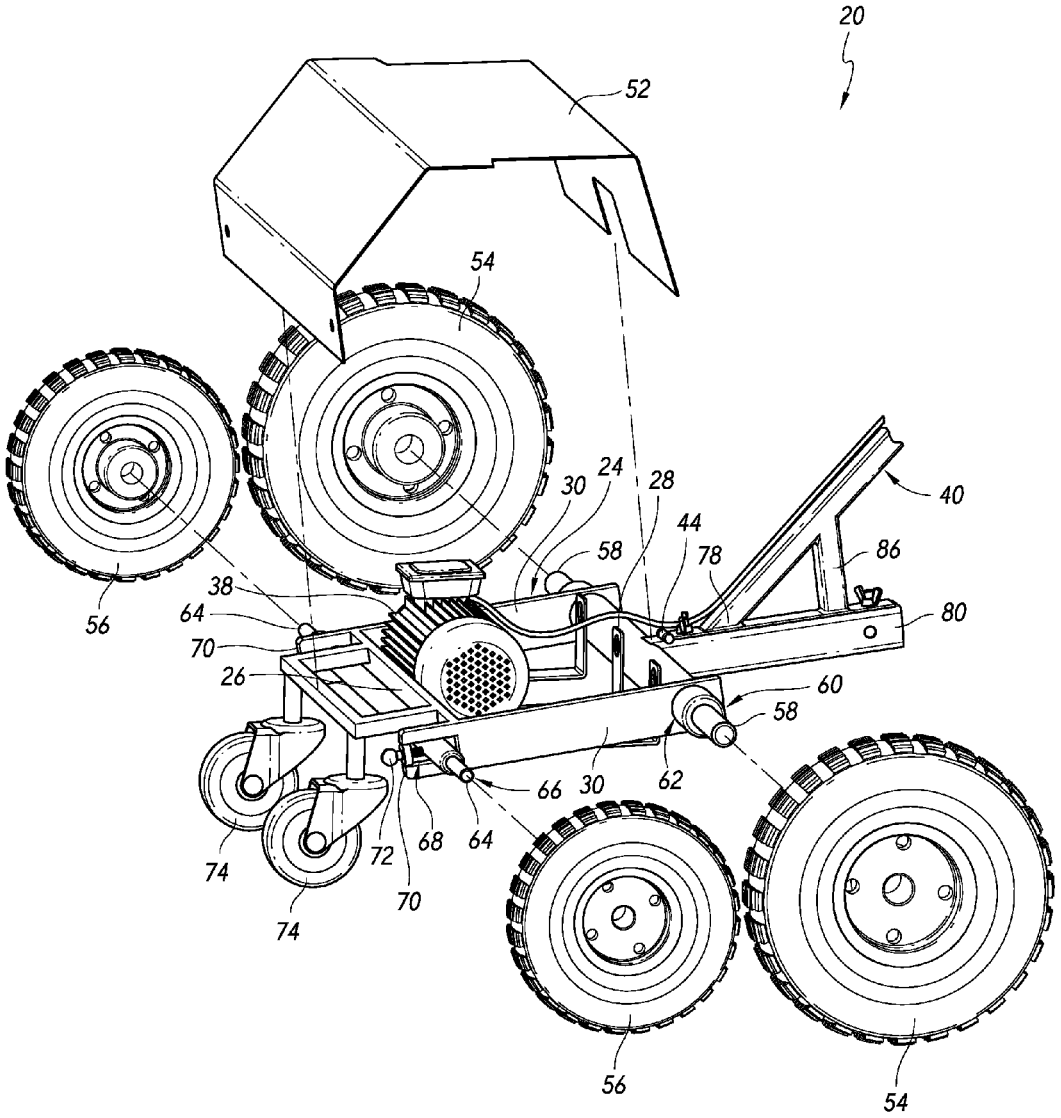
FIG. 2 is an exploded view of the roller system of FIG. 1.

As shown best in FIG. 2, in at least one embodiment, the apparatus 20 also provides a removable cover portion 52 sized and configured for being positioned overtop of and removably engaged with the chassis 24 for covering at least the motor 38. In the exemplary embodiment, the cover portion 52 spans the front and rear ends 26 and 28 of the chassis 24 as well as the sides 30 of the chassis 24.

With continued reference to FIG. 2, in at least one embodiment, the at least one rear rolling member 32 comprises an at least one pair of spaced apart rear wheels 54 positioned on respective sides 30 of the chassis 24, proximal the rear end 28. Similarly, in at least one embodiment, the at least one front rolling member 36 comprises an at least one pair of spaced apart front wheels 56 positioned on respective sides 30 of the chassis 24, proximal the front end 26.

In such embodiments, the rear wheels 54 are engaged with opposing ends 58 of an elongate rear axle 60 that extends through corresponding rear axle apertures 62 provided by the sides 30 of the chassis 24. Similarly, the front wheels 56 are engaged with opposing ends 64 of an elongate front axle 66 that extends through corresponding front axle apertures 68 provided by the sides 30 of the chassis 24.

In at least one such embodiment, as shown in FIG. 2, each of the front axle apertures 68 is configured as an elongate, longitudinally oriented slot rather than a circular hole, which enables the front rolling member 36 (or front wheels 56 in the exemplary embodiment) to be selectively longitudinally moved relatively further from or closer to the rear rolling member 32 (or rear wheels 54 in the exemplary embodiment) in order to create more or less traction/friction between the front and rear rolling members 36 and 32, depending on the size and weight of the rolled object 22 on which the apparatus 20 is to be used—i.e., the larger and heavier the rolled object 22, the greater the traction/friction should be between the front and rear rolling members 36 and 32 for optimum performance of the apparatus 20. As discussed further below, with the front and rear rolling members 36 and 32 positioned in direct contact as well as rolling contact with one another, as the rear rolling member 32 rotates in a forward direction, it causes the front rolling member 36 to rotate in an opposing backward direction—thus, the rear rolling member 32 is capable of propelling the apparatus 20 in a forward direction against the rolled object 22 while the front rolling member 36 contacts the rolled object 22 and causes it to roll or unroll.

Additionally, because the rear rolling member 32 is designed to propel the apparatus 20 and also drive the rotation of the front rolling member 36 (in at least one embodiment), while the front rolling member 36 is designed to contact the rolled object 22, the diameter of the rear rolling member 32 is preferably larger than the diameter of the front rolling member 36. However, in alternate embodiments, the diameters of each of the front and rear rolling members 36 and 32 may take on any other size or relative proportions, dependent in part on the size and weight of the rolled object 22 on which the apparatus 20 is to be used.

In the exemplary embodiment, a leading edge 70 of each side 30 of the chassis 24 provides an adjustment screw 72 threadably engaged therewith and capable of extending a desired distance into the respective elongate front axle aperture 68 for effectively reducing the length of the front axle aperture 68 when the adjustment screw 72 is selectively tightened, thereby moving the front axle 66 (and, thus, the front rolling member 36) relatively closer to the rear rolling member 32. Similarly, as the adjustment screw 72 is loosened, the traction between the front and rear rolling members 36 and 32 is reduced. In further embodiments, any other means for selectively adjusting the traction between the front and rear rolling members 36 and 32, now known or later developed, may be substituted.

In still further embodiments (not shown), the front and rear rolling members 36 and 32 are not in rolling contact with one another; but instead, the motor 38 (or a second motor) drives the opposing rotation—either directly or indirectly—of the front rolling member 36. In a still further embodiment, the motor 38 may be omitted altogether, such that the apparatus 20 is manually operated (i.e., the user 42 pushes the apparatus 20 using the handle portion 40, which causes the rear rolling member 32 to rotate in a forward direction, which causes the front rolling member 36 to rotate in an opposing backward direction, thereby assisting in rolling or unrolling the rolled object 22).

Additionally, while each of the front and rear rolling members 36 and 32 are shown and described in the exemplary embodiment as comprising a pair of spaced apart wheels 56 and 54, in further embodiments, each of the front and rear rolling members 36 and 32 may comprise any other type of rolling means (or combination of rolling means) now known or later developed. For example, in one such embodiment, one or both of the front and rear rolling members 36 and 32 may comprise a plurality of spaced apart wheels in a side-by-side arrangement on respective sides 30 of the chassis 24 (i.e., two or more wheels on each side 30 of the chassis 24)—the number of which could be dictated in part by the size and weight of the rolled object 22 on which the apparatus 20 is to be used.

In another embodiment, one or both of the front and rear rolling members 36 and 32 may comprise a single cylindrical roller. Again, these embodiments are intended to be exemplary and not comprehensive.

With continued reference to FIGS. 1 and 2, in at least one embodiment, the apparatus 20 further provides an at least one caster 74 engaged with the chassis 24 proximal the front end 26 and configured for being in rolling contact with the ground 34 such that, in cooperation with the rear rolling member 32, the front rolling member 36 is elevated a distance D off the ground 34 during use of the apparatus 20 (as shown in FIG. 4). In a bit more detail, because the front rolling member 36 is configured for rotating in a direction opposite to that of the rear rolling member 32, the front rolling member 36 must be elevated off the ground 34 so as to not counteract the forward momentum generated by the rear rolling member 32 during use.

Furthermore, it has been found that having the front rolling member 36 selectively contact the rolled object 22 at or near a horizontal midline 76 of the rolled object 22 (as shown in FIG. 4) provides for the maximum amount of leverage for the apparatus 20 when rolling or unrolling the rolled object 22. Preferably, the front rolling member 36 contacts the rolled object 22 at a point just below the horizontal midline 76, which allows the rolled object 22 to be rolled relatively more tightly.

In the exemplary embodiment, the caster 74 elevates the front rolling member 36 a distance D of four (4) inches off the ground 34, which has been found to be an optimum height at which the front rolling member 36 should contact most types of rolled objects 22. However, in further embodiments, the distance D may ultimately vary depending in part on the size and weight of the rolled object 22 on which the apparatus 20 is to be used.

In still further embodiments, the height of the caster 74 is telescopingly adjustable, thereby allowing the user 42 to selectively adjust the distance D of the front rolling member 36 off the ground 34. In still further embodiments, the at least one caster 74 may be omitted altogether, such that the user 42 simply uses the handle portion 40 to tilt the apparatus 20 back on the rear rolling member 32 so as to elevate the front rolling member 36 the desired distance D off the ground 34, depending on the size of the rolled object 22.

It should be noted that, in embodiments where the diameter of the rear rolling member 32 is larger than the diameter of the front rolling member 36, this difference in size also assists in elevating the front rolling member 36 off the ground 34 during use. It should also be noted that the at least one caster 74 allows the apparatus 20 to selectively adjust its direction of travel, which can be helpful if the rolled object 22 begins to roll (or unroll) in an undesired direction. In other words, the at least one caster 74 may assist in allowing the apparatus 20 to turn and correct the course of the object 22 being rolled or unrolled.

Figure 3:
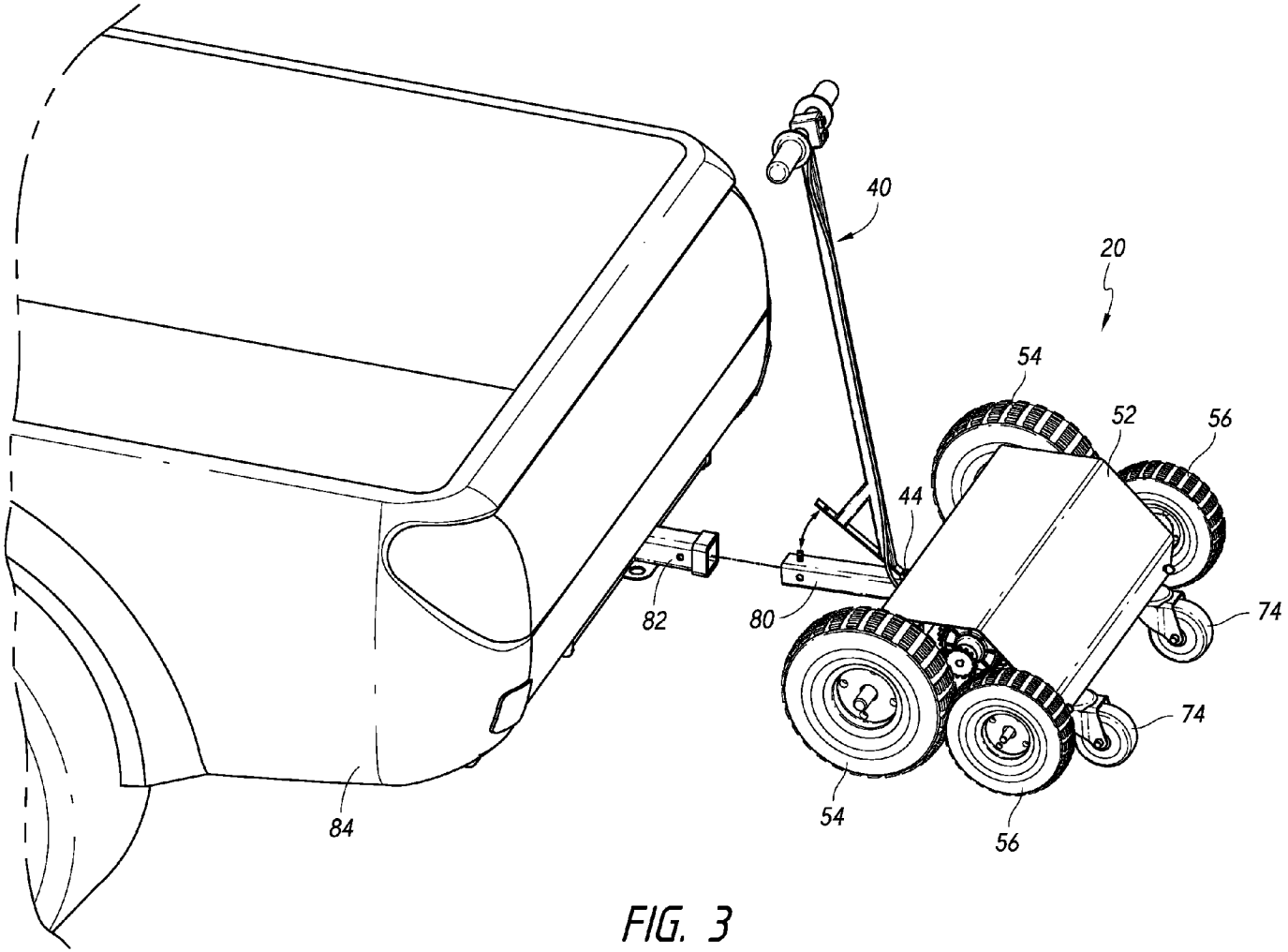
FIG. 3 is an isometric view of the roller system of FIG. 1 in a mounting phase of operation.

As mentioned above, in at least one embodiment, the handle portion 40 is engaged with the rear end 28 of the chassis 24 via the hinge 44. In a bit more detail, and as illustrated in FIG. 3, the hinge 44 is positioned proximal a base 78 of the handle portion 40 and allows the handle portion 40 to be selectively pivoted/folded toward the chassis 24 when not in use.

In at least one such embodiment, the apparatus 20 further provides a substantially horizontally oriented hitch tube 80 sized and configured for being removably inserted within a trailer hitch receiver tube 82 of a vehicle 84 for transporting the apparatus 20. In the exemplary embodiment, the hitch tube 80 is engaged with the rear end 28 of the chassis 24, directly below the base 78 of the handle portion 40.

Thus, with the handle portion 40 selectively folded toward the chassis 24 when the apparatus 20 is not in use, the hitch tube 80 is sufficiently exposed so that it may be subsequently inserted into the receiver tube 82 of the vehicle 84. Additionally, in at least one embodiment, the handle portion 40 provides an at least one substantially vertically oriented support member 86 configured for extending between and contacting the handle portion 40 and the hitch tube 80, when the handle portion 40 is pivoted away from the chassis 24 toward the hitch tube 80, so as to provide additional structural support to the handle portion 40 during use—particularly in embodiments where the user 42 is desirous of selectively tilting the apparatus 20 back on the rear rolling member 32 so as to properly position the front rolling member 36 against the rolled object 22 during use (as discussed above).

As discussed above, the apparatus 20 is configured for assisting in the selective rolling and unrolling of the at least one rolled object 22. FIG. 4 illustrates an exemplary method of using the apparatus 20 to selectively roll up a deflated, flattened inflatable structure (herein, again, simply referred to as the "object" 22), in accordance with at least one embodiment.

In a bit more detail, with the object 22 laid out flat on the ground 34, the user 42 first begins rolling a first end 88 of the object 22 by hand until the rolled object 22 is tall enough—i.e., until a diameter of the rolled object 22 is large enough—to be selectively contacted by the front rolling member 36. The user 42 then positions the apparatus 20 such that the front rolling member 36 contacts the rolled object 22.

With the apparatus 20 so positioned, the user 42 turns on the motor 38 and drives the apparatus 20 in a forward direction against the rolled object 22. The rear rolling member 32 rotates in a forward direction, which causes the front rolling member 36 to rotate in an opposing backward direction, which causes the rolled object 22 to roll in a forward direction as well, which, in turn, causes the rolled object 22 to roll itself up.

Thus, the object 22 is rolled (or unrolled) in the same direction as the rotation of the rear rolling member 32. As the roll 22 gets increasingly larger, the user 42 may optionally press down on the handle portion 40 so as to tip the apparatus 20 back on the rear rolling member 32 and adjust the distance D of the front rolling member 36 off the ground 34, in order to keep the front rolling member 36 at or near the horizontal midline 76 of the rolled object 22 for maximizing the amount of leverage the apparatus 20 has on the rolled object 22.

It should also be noted that the user 42 may optionally employ the assistance of a second person to walk alongside the rolled object 22, while keeping their hands firmly pressed down on the rolled object 22, so as to allow it to be rolled relatively more tightly. Once the object 22 is completely rolled up, the motor 38 is turned off.

The exemplary method of unrolling the rolled object 22 essentially requires the same steps but in reverse order; though, the initial step entails the user 42 first beginning to unroll the rolled object 22 by hand so that an opposing second end 90 of the object 22 is laid out flat on the ground 34, allowing the apparatus 20 to be subsequently positioned thereon for unrolling the object 22 in a direction away from the second end 90 until the object 22 is completely unrolled.

It is contemplated that some embodiments of the roller system can be a motorized roller apparatus for assisting in the selective rolling up of an at least one rolled object, the apparatus comprising: a chassis having a front end, an opposing spaced apart rear end, and two laterally opposed spaced apart sides; the chassis providing a rear rolling member rotatably engaged proximal the rear end and configured for being in rolling contact with the surface on which the rolled object is positioned for enabling the apparatus to travel across the surface in a desired direction; the chassis providing a front rolling member rotatably engaged proximal the front end, a distance above the surface on which the rolled object is positioned, and configured for being selectively positioned in rolling contact with the rolled object; a motor positioned within the chassis and interconnected with the rear rolling member for driving selective rotation of the rear rolling member; and an elongate handle portion engaged with the chassis and configured for allowing a user to operate and steer the apparatus; whereby, during use of the apparatus, with the rear rolling member positioned in rolling contact with the surface on which the rolled object is positioned and the front rolling member positioned in rolling contact with the rolled object itself, the rear rolling member is capable of rotating in a forward direction toward the rolled object while the rear rolling member rotates in an opposing backward direction against the rolled object, thereby causing the rolled object to roll in a forward direction while rolling itself up.

It is further contemplated that the front and rear rolling members are in selective rolling contact with one another such that, as the rear rolling member rotates in a forward direction for propelling the apparatus, the front rolling member is rotated in an opposing backward direction for selectively rolling or unrolling the rolled object; that the handle portion provides a control panel having an at least one control button in communication with, and configured for allowing the user to selectively control, the motor; and that the rear rolling member comprises a pair of spaced apart rear wheels positioned on respective sides of the chassis, proximal the rear end thereof, the rear wheels engaged with opposing ends of an elongate rear axle that extends through corresponding rear axle apertures provided by the sides of the chassis, and the front rolling member comprises a pair of spaced apart front wheels positioned on respective sides of the chassis, proximal the front end thereof, the front wheels engaged with opposing ends of an elongate front axle that extends through corresponding front axle apertures provided by the sides of the chassis.

Further the roller system is contemplated to include a removable cover portion sized and configured for being positioned overtop of and removably engaged with the chassis for covering at least the motor; a caster engaged with the chassis proximal the front end thereof and configured for being in rolling contact with the surface on which the rolled object is positioned such that, in cooperation with the rear rolling member, the front rolling member is elevated a distance off the surface during use of the apparatus and wherein a height of the at least one caster is selectively adjustable.

It is further contemplated that each of the front axle apertures is an elongate, longitudinally oriented slot, thereby enabling the front axle to float therewithin such that the front wheels may be selectively moved closer to or further from the rear wheels for increasing or decreasing, respectively, the traction therebetween; that a leading edge of each side of the chassis provides an adjustment screw threadably engaged therewith and capable of extending a desired distance into the respective front axle aperture for selectively adjusting the distance between the front and rear wheels; and that the front rolling member is configured for being in selective rolling contact with the rolled object at a point just below a horizontal midline of the rolled object.

It is further contemplated that the handle portion is engaged with the rear end of the chassis via a hinge positioned proximal a base of the handle portion, the hinge allowing the handle portion to be selectively folded toward the chassis when the apparatus is not in use; and that the handle portion provides an at least one substantially vertically oriented support member configured for extending between and contacting the handle portion and the hitch tube, when the handle portion is folded away from the chassis toward the hitch tube, so as to provide additional structural support to the handle portion during use of the apparatus.

Further the roller system is contemplated to include a substantially horizontally oriented hitch tube engaged with the rear end of the chassis, directly below the base of the handle portion, the hitch tube sized and configured for being removably inserted within a trailer hitch receiver tube of a vehicle for transporting the apparatus when not in use.

The roller system is further contemplated for assisting in the selective rolling up of an at least one rolled object, and to include a chassis having a front end, an opposing spaced apart rear end, and two laterally opposed spaced apart sides; the chassis providing an at least one rear rolling member rotatably engaged proximal the rear end and configured for being in rolling contact with the surface on which the rolled object is positioned for enabling the apparatus to travel across the surface in a desired direction; the chassis providing an at least one front rolling member rotatably engaged proximal the front end and configured for being in rolling contact with each of the rear rolling member and the rolled object; the chassis providing an at least one caster engaged proximal the front end and configured for being in rolling contact with the surface on which the rolled object is positioned such that, in cooperation with the rear rolling member, the front rolling member is elevated a distance off the surface; a motor positioned within the chassis and interconnected with the rear rolling member for driving selective rotation of the rear rolling member; and an elongate handle portion engaged with the chassis and configured for allowing a user to operate and steer the apparatus; whereby, during use of the apparatus, with the rear rolling member and at least one caster each positioned in rolling contact with the surface on which the rolled object is positioned and the front rolling member positioned in rolling contact with the rolled object itself, the rear rolling member is capable of rotating in a forward direction toward the rolled object while the rear rolling member rotates in an opposing backward direction against the rolled object.

It is contemplated that a method for operating the roller system to roll up a relatively flat object, the method comprising the steps of: positioning the object on a relatively flat surface; rolling a first end of the object by hand until the rolled object is tall enough to be selectively contacted by a front rolling member of the apparatus; positioning the apparatus such that a rear rolling member of the apparatus is in rolling contact with the surface on which the rolled object is positioned and the front rolling member is in rolling contact with the rolled object itself; turning on a motor positioned within a chassis of the apparatus and interconnected with the rear rolling member for driving selective rotation of the rear rolling member; rotating the rear rolling member in a forward direction toward the rolled object which, in turn causes the rear rolling member to rotate in an opposing backward direction against the rolled object, thereby causing the rolled object to roll in a forward direction toward an opposing second end of the rolled object while rolling itself up; and upon the rolled object reaching the opposing second end, turning off the motor.

Further the method of operating the roller system is contemplated to include a step of positioning the front rolling member a distance above the surface so as to keep the front rolling member at or near a horizontal midline of the rolled object, thereby maximizing the leverage the apparatus has on the rolled object; and a step of keeping an at least one hand firmly pressed down on the rolled object, so as to allow it to be rolled up relatively more tightly.

Thus, it has been discovered that the roller system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the roller system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A system comprising:

a rear rolling member configured for rolling contact with a surface;

a front rolling member in direct contact with the rear rolling member and the front rolling member configured to contact and roll or unroll a rolled object by rotating in an opposite direction to the rear rolling member and the front rolling member configured to be elevated above the surface during use; and a chassis coupling the rear rolling member to the front rolling member.

2. The system of claim 1 further comprising a slot for positioning the front rolling member closer to or further from the rear rolling member.

3. The system of claim 1 wherein the front rolling member or the rear rolling member is a wheel.

4. The system of claim 1 wherein the front rolling member is a plurality of spaced apart wheels in a side-by-side arrangement on one side of the chassis.

5. The system of claim 1 further comprising a hitch tube coupled to the chassis.

6. The system of claim 1 further comprising a caster coupled to the chassis for maintaining the front rolling member above the surface.

7. The system of claim 6 wherein the caster is telescopic for adjusting the height of the front rolling member above the surface.

8. The system of claim 1 further comprising a first motor for driving the rear rolling member.

9. A system comprising:

a rear wheel configured for rolling contact with a surface;

a front wheel in direct contact with the rear rolling member and the front rolling member configured to contact and roll or unroll a rolled object by rotating in an opposite direction to the rear wheel and the front wheel configured to be elevated above the surface during use;

a chassis coupling the rear rolling member to the front rolling member;

a handle coupled to the chassis; and a motor configured to drive the rear wheels.

10. The system of claim 9 wherein the handle is attached to the chassis with a hinge.

11. The system of claim 9 wherein the handle includes a control panel for controlling the motor.

12. The system of claim 9 wherein handle is angled away from the chassis to provide leverage for lifting the front wheel higher.

13. The system of claim 9 wherein the front wheel is configured to contact the rolled object at a horizontal midline of the rolled object.

14. The system of claim 13 wherein the horizontal midline is four inches above the surface.

15. The system of claim 13 further comprising a caster that is telescopic for adjusting the front wheel to the midline of the rolled object.

16. The system of claim 9 wherein the diameter of rear wheel is larger than a diameter of the front wheel.

17. The system of claim 9 further comprising a cover that spans a front end and rear end of the chassis.

* * * * *